United States Patent [19]

Hibben

[11] Patent Number: 4,502,219

[45] Date of Patent: Mar. 5, 1985

[54] FOLDING THROWING KNIFE

[76] Inventor: Gilbert W. Hibben, 2703 Costigan Way, Louisville, Ky. 40223

[21] Appl. No.: 425,168

[22] Filed: Sep. 28, 1982

[51] Int. Cl.[3] ..... B26B 5/00; B26B 19/14; A63B 65/08

[52] U.S. Cl. ..... 30/153; 30/347; 273/428

[58] Field of Search ..... 30/153, 303, 302, 333, 30/347, 268, 261; 273/426, 428

[56] References Cited

U.S. PATENT DOCUMENTS

| | | | |
|---|---|---|---|
| 1,512,484 | 10/1924 | Porter | 30/347 |
| 1,744,597 | 1/1930 | Vasconcellos | 30/347 |
| 2,035,689 | 3/1936 | Wing | 273/426 |
| 3,814,431 | 6/1974 | Callahan | 273/426 |
| 4,027,389 | 6/1977 | Atchisson | 273/426 |
| 4,216,962 | 8/1980 | Flemming | 273/426 |
| 4,241,503 | 12/1980 | Sugiyama | 30/268 |

*Primary Examiner*—Paul A. Bell
*Assistant Examiner*—Paul M. Heyrana, Sr.
*Attorney, Agent, or Firm*—Charles G. Lamb

[57] ABSTRACT

A foldable throwing knife having a plurality of blades pivotally connected together for movement between a folded stored position in which the blades are in overlaying stacked relationship, and an unfolded throwing position wherein the blades are coplanar and at a predetermined angular displacement relative to each other. The blades include nesting notches for holding the blades in the unfolded throwing position. The knife blades are resiliently biased toward each other for forcing the notches into nesting relationship when the blades are in the unfolded throwing position.

9 Claims, 5 Drawing Figures

FOLDING THROWING KNIFE

BACKGROUND OF THE INVENTION

1. Field of the Invention

The present invention relates to knives, and the like, especially intended for throwing, and more particularly, to a throwing knife having blades which are moveable between a stored folded position and an unfolded throwing position.

2. Description of the Prior Art

Throwing knives, and the like, are, of course, well known, and have been used throughout history for sport, warfare and hunting.

Examples of known throwing knives, and the like, are shown in the U.S. Pat. No. De. 170,824 issued to G. J. Kunderkoff on Nov. 10, 1953; U.S. Pat. No. 2,361,988 issued to W. B. Bonnifield on Nov. 7, 1944; U.S. Pat. No. 2,714,509 issued to J.C. Ramsey on Aug. 2, 1955; U.S. Pat. No. 3,507,497 issued to R. C. Gardner on Apr. 21, 1970; and, U.S. Pat. No. 4,027,389 issued to Maxwell G. Atchisson on June 7, 1977.

U.S. Pat. No. 170,824 shows a throwing dagger having a single unitary blade with sharp points at both ends of the blade.

U.S. Pat. No. 2,361,988 shows a folding three bladed boomerang. The three blades are pivotally connected together at one end of each blade by a pin. One end of the first blade has two notches, and one end of each of the other two blades has a finger. In the unfolded throwing position, the blades are pivoted about the pin until the fingers of the two blades fit into a different one of the notches in the first blade, thus, locking the blades in the unfolded position in different parallel planes.

U.S. Pat. No. 2,714,509 shows various configured multi-pointed knives of unitary construction.

U.S. Pat. No. 3,507,497 shows a folding double boomerang comprised of two, more or less conventionally shaped, boomerangs pivotally connected together at their mid-sections by a threaded rod and wing nut. The double boomerangs are held together in two different parallel planes by friction when the wing nut is tightened.

U.S. Pat. No. 4,027,389 shows a multiple bladed foldable throwing knife having four individual blades. Each blade is formed, at one end, with studs arranged in a square pattern of dimples in the opposite flat blade surface. A hole is formed through each blade geometrically centered in the square pattern of the studs and dimples. The knife blades are in overlaying stacked relationship and held together by a bolt received through the holes in the blades and a wing nut threaded on the bolt. In both the unfolded throwing position, and folded stored position, the studs of each blade fit into the dimples of the adjacent blade and the wing nut is tightened to prevent the blades from pivoting relative to each other. In the unfolded throwing position, the blades are in different parallel planes.

SUMMARY OF THE INVENTION

The present invention provides a foldable throwing knife wherein when the knife blades are in the unfolded throwing position the blades are coplanar.

The present invention further provides a foldable throwing knife wherein the blades are connected together for selected pivotal movement relative to each other.

The present invention even further provides a foldable throwing knife wherein the knife blades are held against inadvertent pivotal movement relative to each other.

The present invention still further provides a foldable throwing knife wherein the knife blades are held against inadvertent pivotal movement relative to each other.

The present invention still further provides a foldable throwing knife wherein the knife blades are resiliently biased toward each other.

More particularly, the present invention provides a foldable throwing knife comprising a plurality of blades; interconnecting means for holding the blades together and allowing selected relative pivotal movement of the blades between a folded stored position in which the blades are in a stacked overlaying relationship, and an unfolded throwing position in which the blades are at a predetermined angular displacement relative to each other; and, means associated with the blades for holding the blades at the predetermined angular displacement and in coplanar relationship.

BRIEF DESCRIPTION OF THE DRAWINGS

The present invention will become even more clear upon reference to the following detailed description and accompanying drawings in which like parts are identified by like numerals throughout the several views and in wherein.

DETAILED DESCRIPTION OF THE PREFERRED EMBODIMENT

The Figures illustrate a folded throwing knife, or the like, generally denoted as the number 10. The throwing knife 10 is shown as comprising two identical blades 12A and 12B which are pivotally interconnected for selective pivotal movement relative to each other between a folded, stored position (shown in FIGS. 2 and 4) and an unfolded, throwing position (shown in FIGS. 1 and 3). However, it should be clearly understood that these are not limiting features of the present invention in that a knife embodying the present invention can just as readily be constructed of more than two blades, and with two or more blades which are not identical with each other.

Figure 5:
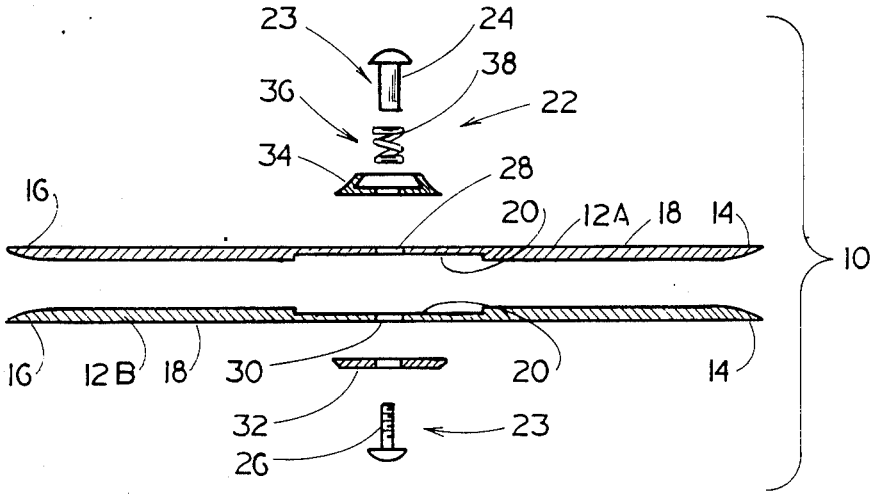

The two blades 12A and 12B are shown as being virtually idential, and each comprises oppositely disposed, pointed ends 14 and 16, and sharpened edges 18. The blades 12A and 12B further comprise means for holding the blades in the unfolded throwing position, shown in FIGS. 1 and 3, wherein the blades are at a predetermined angular displacement, for example 90°, relative to each other and in coplanar relationship. As can be best seen in FIGS. 4 and 5, the holding means comprises a notch 20 formed in each blade 12A and 12B proximate the mid-section thereof, which notch 20 extends transversely across the width of the blade. When the blades 12A and 12B are pivoted to the unfolded, throwing position, the notches 20 nest together (see FIG. 3). When the blades 12A and 12B are pivoted to the folded, stored position, the notches 20 are not nested together and the blades 12A and 12B are in overlaying stacked relationship (see FIG. 4). Preferrably, the depth of each notch 20 corresponds to one-half of the thickness of the blade in which it is formed so that when the blades are in the unfolded, throwing position, the blades 12A and 12B are coplanar, as can be seen in FIG. 3.

The blades 12A and 12B are held together by interconnecting means, generally denoted as the number 22, which also allows selected relative pivotal movement of the blades between the folded, stored position and unfolded, throwing position. The interconnecting means 22 can best be seen in FIGS. 4 and 5. As shown, the interconnecting means 22 comprises on axle assembly 23 which includes an internally threaded bolt 24 and an externally threaded bolt 26. The internally threaded bolt 24 is received through an appropriate aperture 28 formed at the geometric center of the blade 12A and an appropriate aperture 30 formed at the geometric center of the blade 12B from one side of the knife, and the externally threaded bolt 26 is threadably received in the internally threaded bolt 24 from the opposite side of the knife. As illustrated, a washer 32 is located between the head of the externally threaded bolt 26 and the adjacent blade 12B, and a hat section-type washer 34 is located between the head of the internally threaded bolt 24 and adjacent blade 12A. It should be noted at this point, that the axle 23 is longer than the thickness of a blade, and is longitudinally movable in the apertures 28 and 30 formed in the blades 12A and 12B, respectively. Thus, the blades 12A and 12B pivot about the axle 23 as they pivot between the folded stored position and unfolded throwing position. With continued reference to FIGS. 4 and 5, the interconnecting means 22 further comprises biasing means 36 for constantly, resiliently biasing the blades 12A and 12B toward each other. Toward this end, the biasing means 36 is illustrated as a compression coil spring 38 coaxially received over the shank of the internally threaded bolt 24 and compressively caged between the head of the bolt 24 and bottom surface of the hat shaped washer 34. It is realized that the interconnecting means may include other means for connecting the blades 12A and 12B in a nesting relationship without departing from the scope and spirit of my invention.

Figure 2:
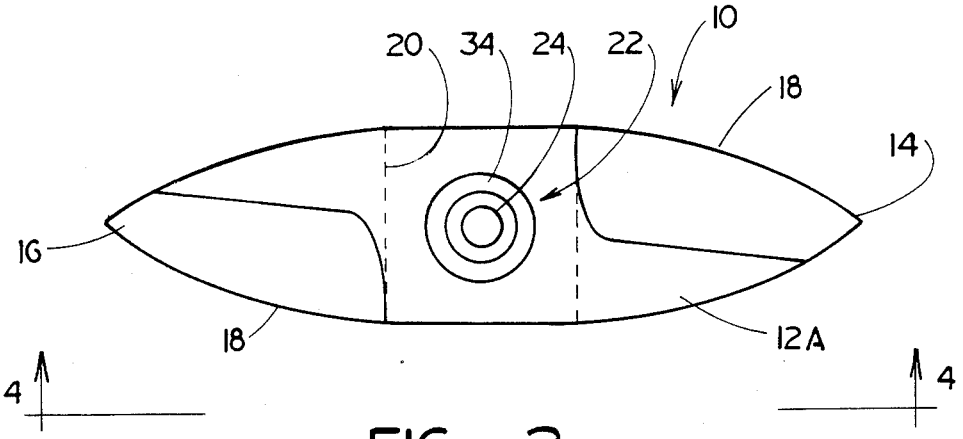
FIG. 2 is a plan view of the knife of FIG. 1 in a folded stored position.
Figure 4:
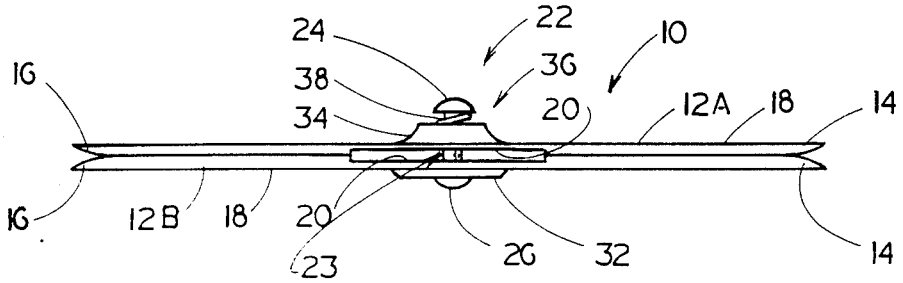
FIG. 4 is a side view of the knife in the folded stored position as viewed in the direction of arrows 4—4 in FIG. 2; and, FIG. 5 is a cross-sectioned, exploded side view of the knife in the folded stored position.

When in the folded, stored position shown in FIGS. 2 and 4, the blades 12A and 12B are forced toward each other by the biasing force of the compression spring 38 so that the facing flat surfaces of the blades 12A and 12B are in contact. The friction between the facing flat blade surfaces tends to prevent the blades 12A and 12B from inadvertently pivoting from the folded, stored position.

Figure 1:
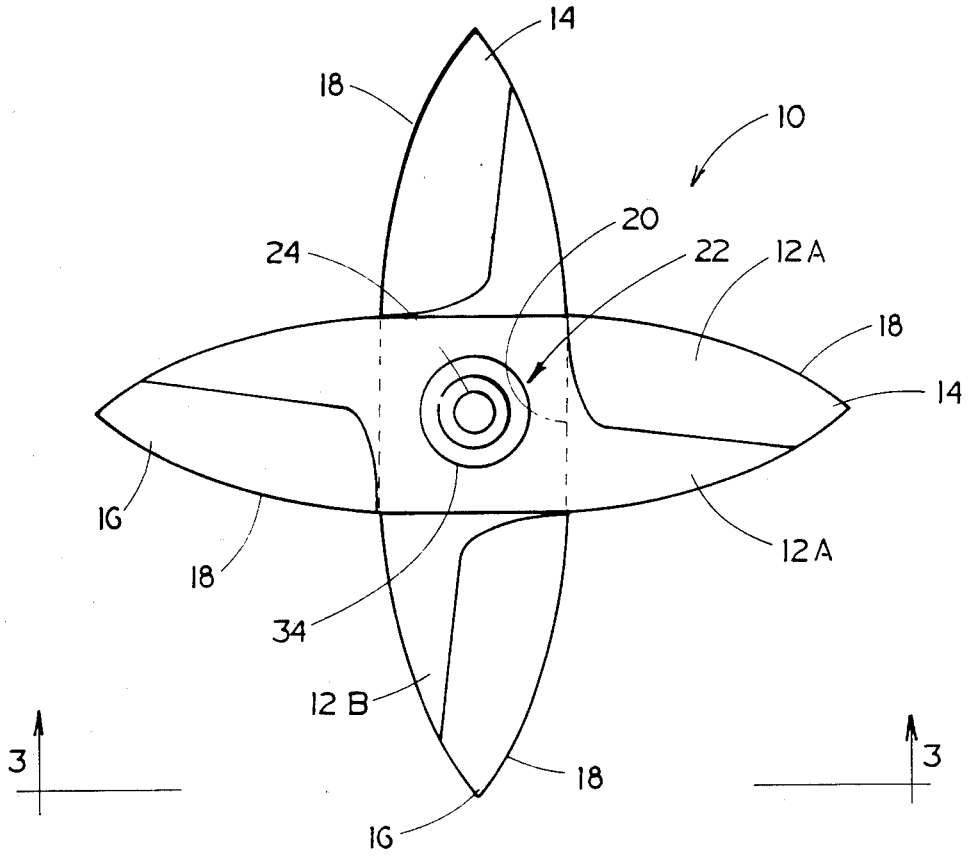
FIG. 1 is a plan view of the throwing knife of the present invention in an unfolded throwing position.
Figure 3:
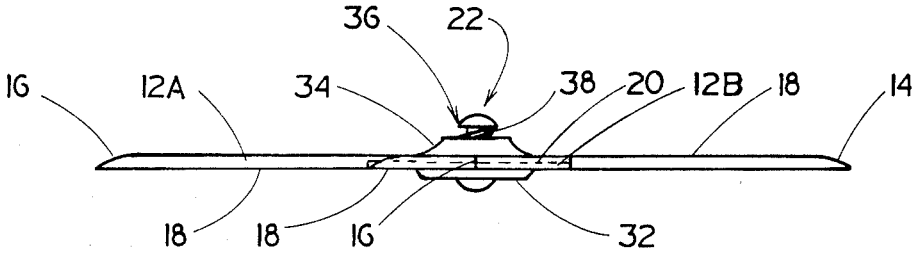
FIG. 3 is a side view of the knife in the unfolded throwing position as viewed in the direction of arrows 3—3 in FIG. 1.

When it is desired to pivot the blades 12A and 12B from the folded, stored position to the unfolded, throwing position shown in FIGS. 1 and 3, one of the blades 12A and 12B is manually pivoted relative to the other blade about the axle 23 until the notches 20 of the blades 12A and 12B come into nesting alignment, with the blades at the predetermined angular displacement, at which time the biasing force of the spring 36 pulls the blades towards each other causing the notches to mate in nesting relationship. The nested notches 20 thus hold the blades 12A and 12B in the unfolded throwing position.

In order to move the blades 12A and 12B from the unfolded throwing position to the folded stored position, the axle 23 is manually, longitudinally displaced against the biasing force of the spring 38 by, for example, pressing against the head of the bolt 24. This relieves the force biasing the blades 12A and 12B toward each other and allows the notches 20 to be moved out of nesting relationship. With the axle 23 longitudinally displaced, the blades 12A and 12B can be manually pivoted about the axle 23 from the unfolded position to the folded, overlaying stored position.

The foregoing detailed description is given primarily for clearness of understanding and no unnecessary limitations are to be understood therefrom for modifications will become obvious to one skilled in the art upon reading this disclosure and may be made without departing from the spirit of the invention or scope of the appended claims.

What I claim is:

1. A foldable throwing knife comprising:

a plurality of blades;

interconnecting means for holding said blades together and allowing selected relative pivotal movement of said blades between a folded stored position in which said blades are in a stacked overlaying relationship, and an unfolded throwing position in which said blades are at a predetermined angular displacement relative to each other, said interconnecting means includes biasing means for resiliently biasing said blades toward each other; and, means associated with said blades for holding said blades at the predetermined angular displacement and in coplanar relationship.

2. The foldable throwing knife of claim 1, wherein said means for holding said blades at the predetermined angular displacement and in coplanar relationship comprises means formed in said blades which nest together.

3. The foldable throwing knife of claim 2, wherein said nesting means comprises notches formed in each of said blades which nest together only when said blades are in the unfolded throwing position.

4. The foldable throwing knife of claim 3, wherein the nestable notches formed in each of said blades are identical.

5. The foldable throwing knife of claim 4, wherein said notches formed in each blade is located proximate the mid-section of said blade.

6. The foldable throwing knife of claim 1, wherein said interconnecting means further comprises means for selectively relieving the force of the biasing means which forces said blades toward each other.

7. The foldable throwing knife of claim 1, wherein said blades are identical.

8. The foldable throwing knife of claim 1, wherein said interconnecting means is located proximate the geometric center of said blades.

9. The foldable throwing knife of claim 1, wherein said interconnecting means comprises an axle about which said blades pivot between the folded stored position and unfolded throwing position.

* * * * *